US009614276B2

(12) United States Patent
Pinto et al.

(10) Patent No.: US 9,614,276 B2
(45) Date of Patent: Apr. 4, 2017

(54) ANTENNA APPARATUS AND METHODS

(75) Inventors: Alexandre Pinto, Copenhagen (DK); Mirsad Cviko, Malmö (SE)

(73) Assignee: Nokia Technologies Oy, Espoo (FI)

( * ) Notice: Subject to any disclaimer, the term of this patent is extended or adjusted under 35 U.S.C. 154(b) by 7 days.

(21) Appl. No.: 13/876,231

(22) PCT Filed: Oct. 6, 2010
(Under 37 CFR 1.47)

(86) PCT No.: PCT/IB2010/054524

§ 371 (c)(1),
(2), (4) Date: Jun. 24, 2013

(87) PCT Pub. No.: WO2012/046103

PCT Pub. Date: Apr. 12, 2012

(65) Prior Publication Data

US 2014/0225801 A1 Aug. 14, 2014

(51) Int. Cl.

| | |
|---|---|
| ***H01Q 1/24*** | (2006.01) |
| ***H01Q 1/48*** | (2006.01) |
| ***H01Q 5/00*** | (2015.01) |
| ***H01Q 9/04*** | (2006.01) |
| ***H01Q 9/42*** | (2006.01) |
| *H01Q 5/30* | (2015.01) |

(52) U.S. Cl.
CPC ..... *H01Q 1/48* (2013.01); *H01Q 1/243* (2013.01); *H01Q 9/0421* (2013.01); *H01Q 9/42* (2013.01); *H01Q 5/30* (2015.01); *Y10T 29/49018* (2015.01)

(58) Field of Classification Search
CPC H01Q 5/00; H01Q 5/30; H01Q 5/307; H01Q 5/35; H01Q 1/243; H01Q 1/48
USPC ..... 343/848, 846
See application file for complete search history.

(56) References Cited

U.S. PATENT DOCUMENTS

| | | | | |
|---|---|---|---|---|
| 6,008,774 | A | 12/1999 | Wu | 343/828 |
| 6,333,716 | B1 | 12/2001 | Pontoppidan | 343/702 |
| 6,404,395 | B1 | 6/2002 | Masuda | 343/702 |
| 6,624,789 | B1 * | 9/2003 | Kangasvieri et al. | 343/702 |
| 6,864,845 | B2 | 3/2005 | Kuo et al. | 343/702 |

(Continued)

FOREIGN PATENT DOCUMENTS

| | | |
|---|---|---|
| CN | 1261211 A | 7/2000 |
| CN | 1495966 A | 5/2004 |

(Continued)

OTHER PUBLICATIONS

Liang, Jing, Yang, H.Y. David; "Multi-Band Frequency Reconfigurable Planar Inverted-F Antenna Designs"; URSI XXIX; 4 pgs.

(Continued)

*Primary Examiner* — Dameon E Levi
*Assistant Examiner* — Jennifer F Hu
(74) *Attorney, Agent, or Firm* — Harrington & Smith

(57) ABSTRACT

An apparatus including: a first ground member; a second ground member extending from the first ground member and including a feed point, the feed point being configured to receive a signal in a first frequency band and to receive an antenna configured to operate in the first frequency band, the first ground member and the second ground member having an electrical length configured to provide a resonant mode in the first ground member and the second ground member in the first frequency band.

20 Claims, 10 Drawing Sheets

(56) References Cited

U.S. PATENT DOCUMENTS

| | | | | |
|---|---|---|---|---|
| 7,098,852 | B2 * | 8/2006 | Ikuta | H01Q 1/38 343/700 MS |
| 7,498,992 | B2 * | 3/2009 | Hung | H01Q 9/42 343/700 MS |
| 7,642,972 | B1 | 1/2010 | Yu et al. | 343/702 |
| 8,259,026 | B2 * | 9/2012 | Pulimi | H01Q 1/243 343/702 |
| 8,344,962 | B2 * | 1/2013 | Hui | H01Q 1/242 343/848 |
| 2002/0145569 | A1 * | 10/2002 | Onaka | H01Q 1/22 343/702 |
| 2004/0058723 | A1 * | 3/2004 | Mikkola | H01Q 1/243 455/575.7 |
| 2008/0012769 | A1 | 1/2008 | Cheng | 343/700 |
| 2009/0051604 | A1 * | 2/2009 | Zhang | H01Q 1/243 343/702 |
| 2009/0256763 | A1 | 10/2009 | Chi et al. | 343/741 |
| 2010/0214175 | A1 * | 8/2010 | Hui | H01Q 1/243 343/700 MS |
| 2010/0279747 | A1 * | 11/2010 | Imano | H01Q 1/243 455/575.3 |
| 2011/0032166 | A1 | 2/2011 | Zhang et al. | 343/767 |

FOREIGN PATENT DOCUMENTS

| | | | |
|---|---|---|---|
| CN | 201210523 | Y | 3/2009 |
| CN | 201498592 | U | 6/2010 |
| CN | 101821900 | A | 9/2010 |
| EP | 1-401-050 | A1 | 3/2004 |
| EP | 1-670-093 | A1 | 6/2006 |
| EP | 1-835-561 | A2 | 9/2007 |
| EP | 2-037-533 | A1 | 3/2009 |
| WO | WO-2008-029193 | A1 | 3/2008 |
| WO | WO-2009-037353 | A1 | 3/2009 |

OTHER PUBLICATIONS

Lee, Chi-Hun, Park, Seong-Ook; "A Compact Printed Hook-Shaped Monopole Antenna for 2.4/5-GHz WLAN Applications"; Microwave and Optical Technology Letters, vol. 48, No. 2, Feb. 2006; p. 327-329.

Yang, H.Y.D, Zhang, Y.Y.; "A Wideband Miniaturized Dipole Antenna on a Printed Circuit Board"; Progress in Electromagnetics Research C, vol. 10, 2009; p. 175-185.

* cited by examiner

ANTENNA APPARATUS AND METHODS

TECHNOLOGICAL FIELD

Embodiments of the present invention relate to apparatus and methods. In particular, they relate to apparatus in a portable electronic device.

BACKGROUND

Apparatus, such as portable electronic communication devices, usually include radio circuitry and one or more antennas for enabling the apparatus to communicate wirelessly with other apparatus. In recent years, user demand has led to such apparatus being reduced in size. However, this reduction in size has often led to a decrease in performance and/or efficiency of the one or more antennas.

It would therefore be desirable to provide an alternative apparatus.

BRIEF SUMMARY

According to various, but not necessarily all, embodiments of the invention there is provided an apparatus comprising: a first ground member; a second ground member extending from the first ground member and comprising a feed point, the feed point being configured to receive a signal in a first frequency band and to receive an antenna configured to operate in the first frequency band, the first ground member and the second ground member having an electrical length configured to provide a resonant mode in the first ground member and the second ground member in the first frequency band.

The apparatus may be for wireless communications.

The first ground member and the second ground member may be integral with one another. The second ground member may be elongate and may have a first end and a second opposite end. The second ground member may be coupled to the first ground member at the first end, the second end being open.

The feed point may be positioned at or adjacent the second end of the second ground member. The feed point may be coupled to radio circuitry without an intervening matching circuit between the feed point and the radio circuitry. The feed point may be coupled to radio circuitry via an intervening matching circuit.

The apparatus may further comprise the antenna. The antenna may be configured to operate in the first frequency band. The antenna may be coupled to the feed point and may be at least partially oriented parallel to the second ground member. The antenna may at least partially overlay the second ground member. The antenna may wholly overlay the second ground member. The antenna may at least partially overlay the first ground member.

The apparatus may further comprise a third ground member including a further feed point. The further feed point may be configured to receive a signal in a further frequency band and to receive a further antenna configured to operate in the further frequency band. At least the first ground member and the third ground member may have an electrical length configured to provide a resonant mode in at least the first ground member and the third ground member in the further frequency band.

The third ground member may extend from the first ground member or may extend from the second ground member.

According to various, but not necessarily all, embodiments of the invention there is provided a module comprising an apparatus as described in any of the preceding paragraphs.

According to various, but not necessarily all, embodiments of the invention there is provided a portable electronic device comprising an apparatus as described in any of the preceding paragraphs.

According to various, but not necessarily all, embodiments of the invention there is provided a method comprising: providing a first ground member and a second ground member extending from the first ground member and comprising a feed point, the feed point being configured to receive a signal in a first frequency band and to receive an antenna configured to operate in the first frequency band, the first ground member and the second ground member having an electrical length configured to provide a resonant mode in the first ground member and the second ground member in the first frequency band.

The first ground member and the second ground member may be integral with one another. The second ground member may be elongate and may have a first end and a second opposite end. The second ground member may be coupled to the first ground member at the first end, the second end being open.

The feed point may be positioned at or adjacent the second end of the second ground member. The feed point may be coupled to radio circuitry without an intervening matching circuit between the feed point and the radio circuitry.

The feed point may be coupled to radio circuitry via an intervening matching circuit.

The method may further comprise providing the antenna configured to operate in the first frequency band. The method may further comprise coupling the antenna to the feed point so that the antenna is oriented at least partially parallel to the second ground member. The antenna may at least partially overlay the second ground member. The antenna may wholly overlay the second ground member. The antenna may at least partially overlay the first ground member.

A third ground member may include a further feed point. The further feed point may be configured to receive a signal in a further frequency band and to receive a further antenna configured to operate in the further frequency band. At least the first ground member and the third ground member may have an electrical length configured to provide a resonant mode in at least the first ground member and the third ground member in the further frequency band. The third ground member may extend from the first ground member or extend from the second ground member.

BRIEF DESCRIPTION

For a better understanding of various examples of embodiments of the present invention reference will now be made by way of example only to the accompanying drawings in which.

DETAILED DESCRIPTION

Figure 1:
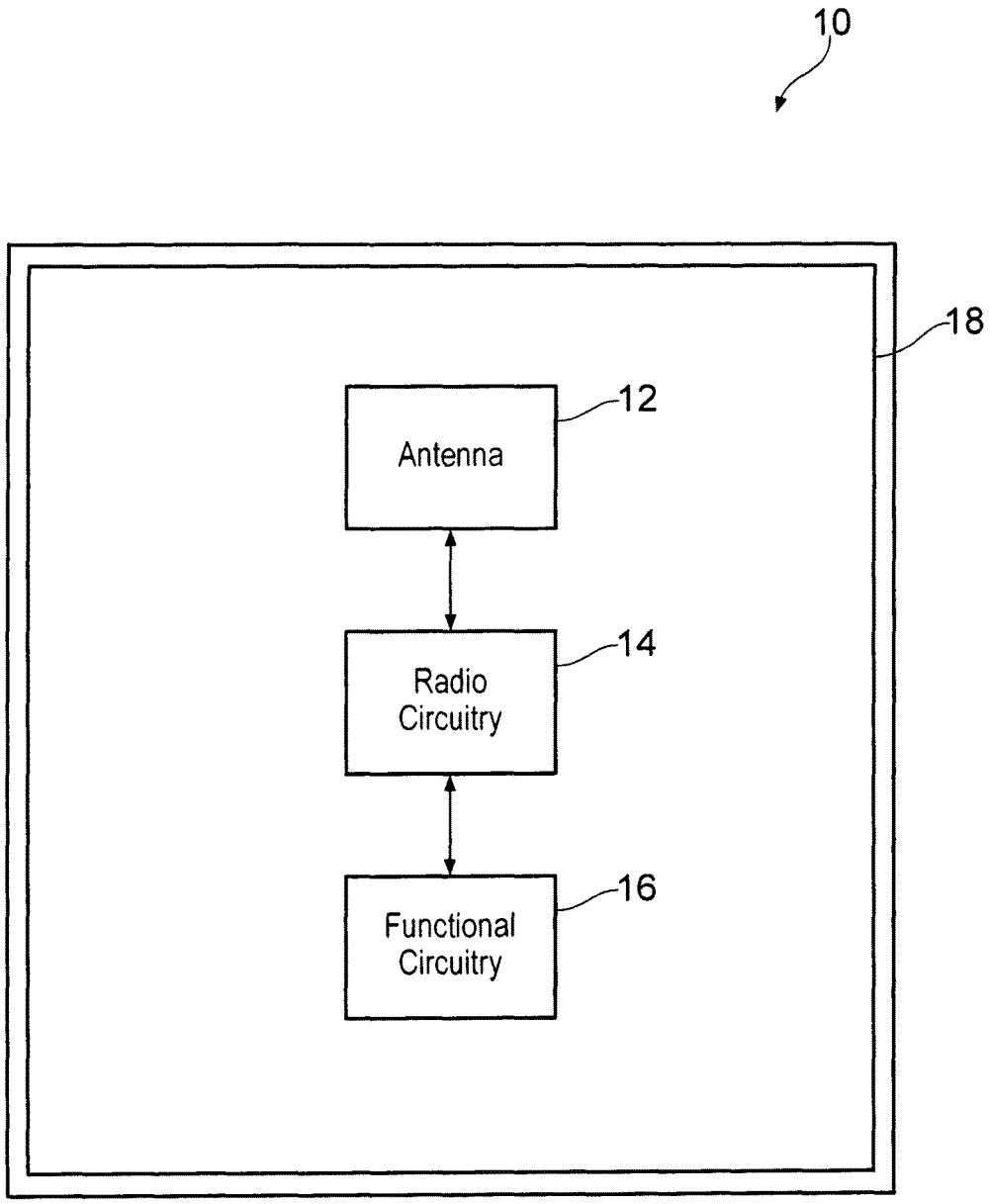
FIG. 1 illustrates a schematic diagram of an apparatus according to various embodiments of the present invention.

In the following description, the wording 'connect' and 'couple' and their derivatives mean operationally connected or coupled. It should be appreciated that any number or combination of intervening components can exist (including no intervening components). Additionally, it should be appreciated that the connection or coupling may be a physical galvanic connection and/or an electromagnetic connection.

The figures illustrate an apparatus 10, 101, 102, 103, 104, 105, 106 comprising: a first ground member 20; a second ground member 22 extending from the first ground member 20 and comprising a feed point 42, the feed point 42 being configured to receive a signal in a first frequency band and to receive an antenna 50 configured to operate in the first frequency band, the first ground member 20 and the second ground member 22 having an electrical length 44 configured to provide a resonant mode in the first ground member 20 and the second ground member 22 in the first frequency band.

In more detail, FIG. 1 illustrates an apparatus 10 such as a portable electronic device (for example, a mobile cellular telephone, a tablet computer, a laptop computer, a personal digital assistant or a hand held computer), a non-portable electronic device (for example, a personal computer or a base station for a cellular network) or a module for such devices. As used here, 'module' refers to a unit or apparatus that excludes certain parts or components that would be added by an end manufacturer or a user.

The apparatus 10 comprises an antenna 12, radio circuitry 14, functional circuitry 16 and a ground member 18. The antenna 12 is configured to transmit and receive, transmit only or receive only electromagnetic signals. The radio circuitry 14 is connected between the antenna 12 and the functional circuitry 16 and may include a receiver and/or a transmitter. The functional circuitry 16 is operable to provide signals to, and/or receive signals from the radio circuitry 14. The apparatus 10 may optionally include one or more matching circuits between the antenna 12 and the radio circuitry 14.

In the embodiment where the apparatus 10 is a portable electronic device, the functional circuitry 16 may include a processor, a memory and input/output devices such as an audio input device (a microphone for example), an audio output device (a loudspeaker for example) and a display.

The antenna 12 and the electronic components that provide the radio circuitry 14 and the functional circuitry 16 may be interconnected via the ground member 18 (for example, a printed wiring board). The ground member 18 may be used as a ground plane for the antenna 12 by using one or more layers of the printed wiring board 18. In other embodiments, some other conductive part of the apparatus 10 (a battery cover for example) may be used as the ground member 18 for the antenna 12. The ground member 18 may be formed from several conductive parts of the apparatus 10, for example and not limited to the printed wiring board, a conductive battery cover, and/or at least a portion of an external conductive casing or housing of the apparatus 10. The ground member 18 may be planar or non-planar.

The antenna 12 and the radio circuitry 14 may be configured to operate in one or more operational frequency bands and via one or more protocols. For example, the operational frequency bands and protocols may include (but are not limited to) Long Term Evolution (LTE) 700 (US) (698.0-716.0 MHz, 728.0-746.0 MHz), LTE 1500 (Japan) (1427.9-1452.9 MHz, 1475.9-1500.9 MHz), LTE 2600 (Europe) (2500-2570 MHz, 2620-2690 MHz), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); hyper local area network (HLAN) (5150-5850 MHz); global positioning system (GPS) (1570.42-1580.42 MHz); US-Global system for mobile communications (US-GSM) 850 (824-894 MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting-handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification low frequency (RFID LF) (0.125-0.134 MHz); radio frequency identification high frequency (RFID HF) (13.56-13.56 MHz); radio frequency identification ultra high frequency (RFID UHF) (433 MHz, 865-956 MHz, 2450 MHz).

A frequency band over which an antenna can efficiently operate using a protocol is a frequency range where the antenna's return loss is greater than an operational threshold. For example, efficient operation may occur when the antenna's return loss is better than −6 dB or −10 dB.

Figure 2:
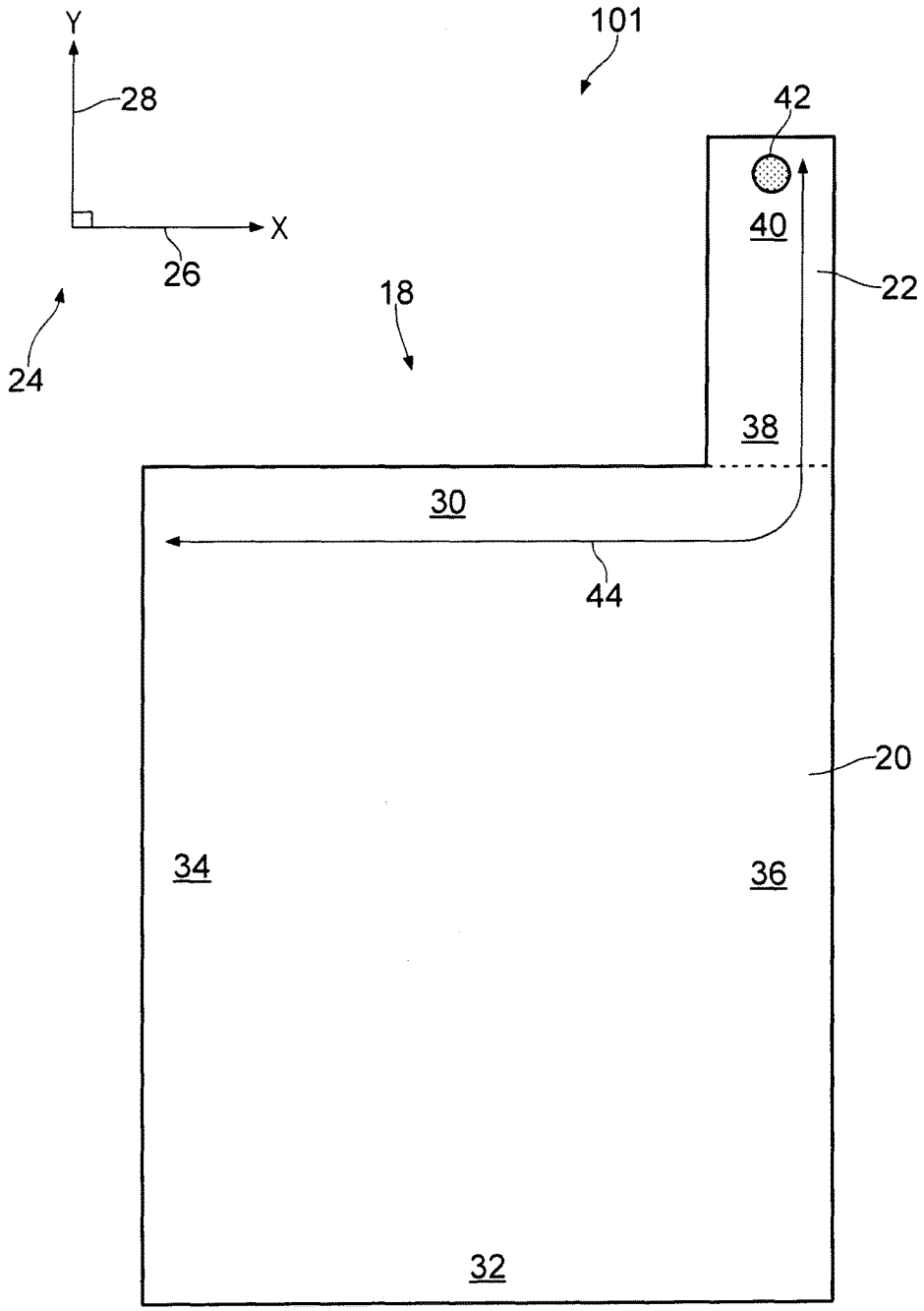
FIG. 2 illustrates a schematic diagram of another apparatus according to various embodiments of the present invention.

FIG. 2 illustrates a schematic diagram of another apparatus 101 according to various embodiments of the present invention. The apparatus 101 includes a ground member 18 which comprises a first ground member 20 and a second ground member 22. FIG. 2 also illustrates a Cartesian co-ordinate axis 24 which includes an X axis 26 and a Y axis 28. The X axis 26 is orthogonal to the Y axis 28.

The first ground member 20 forms a rectangular plane and has a first edge 30, a second edge 32, a third edge 34 and a fourth edge 36. The first edge 30 and the second edge 32 are opposite one another and are oriented parallel with the X axis 26. The third edge 34 and the fourth edge 36 are opposite one another, extend between the first and second edges 30, 32, and are oriented parallel with the Y axis 28. The third and fourth edges 34, 36 are longer than the first and second edges 30, 32 (in other embodiments, the third and fourth edges 34, 36 may be shorter than the first and second edges 30, 32). It should be appreciated that in other embodiments, the first ground member 20 may be non-planar (for example, the first ground member 20 may be curved) and may have any suitable shape (for example, the first ground member 20 may form a pentagon and have five edges).

The second ground member 22 also forms a rectangular plane in shape and is co-planar with the first ground member 20. The second ground member 22 has a first end 38 and a second end 40. The first end 38 of the second ground member 22 is coupled to the first edge 30 of the first ground member 20 (at the corner defined by the first edge 30 and the fourth edge 36) and the second end 40 is open or free. The second ground member 22 extends from the first ground member 20 in the +Y direction. It should be appreciated that in other embodiments, the first ground member 20 may be non-planar, may not be co-planar with the first ground member 20, may have any suitable shape (for example, 'L' shaped, 'G' shaped or an arc of a circle having a radius) and may extend from any edge of the first ground member 20 in any direction. Furthermore, the second ground member 22 may partially or wholly overlay the first ground plane 20 (when viewed in plan view).

In some embodiments, the first ground member 20 and the second ground member 22 may be integral with one another. For example, the first ground member 20 and the second ground member 22 may be formed from the same block of material by cutting out their respective shapes (for example, they may be formed from a single printed wiring board). In other embodiments, the first ground member 20 and the second ground member 22 may not be integral and may be coupled together (by soldering for example).

The second ground member 22 includes a feed point 42 that is positioned at the second end 40 and is configured to receive an antenna (not illustrated in the figure). In other embodiments, the feed point 42 may be positioned adjacent the second end 40 and a portion of the second ground member 22 may extend from the feed point 42 to the second end 40. In some embodiments, the feed point 42 may be configured such that it forms a conductive point to which an antenna may be connected (via soldering or by providing a conductive pad on the surface of a printed wiring board to which a spring leaf antenna connector may be coupled, the spring leaf connector may be an integral part of the antenna or it may be a separate part, for example).

In other embodiments, the feed point 42 may be configured such that it forms a conductive connector that holds and fixes the antenna in place. The feed point 42 may be configured to receive signals in a first frequency band from the radio circuitry 14 and/or may be configured to provide signals in a first frequency band to the radio circuitry 14.

The antenna is configured to operate in the first frequency band. The antenna may be configured, for example, in that it has an electrical length that is substantially equal to a quarter of a wavelength corresponding to the first frequency band. The antenna may be any suitable antenna and may be and not limited to, for example, a monopole, an inverted L antenna (ILA), a planar inverted L antenna (PILA), an inverted F antenna (IFA), a planar inverted F antenna (PIFA) or a loop antenna.

The first ground member 20 and the second ground member 22 have an electrical length 44 that is configured to provide a resonant mode in the first ground member 20 and the second ground member 22 in the first frequency band. In this example, the electrical length 44 extends from the feed point 42 in the −Y direction for the length of the second ground member 22 and then extends in the −X direction and runs along the first edge 30 of the first ground member 20 to the third edge 34. The electrical length 44 is substantially equal to half a wavelength of the first frequency band (and thus enables a standing wave along the electrical length 44 in the first frequency band). In other embodiments, the electrical length 44 may follow a different path and may be any integer multiple of quarter of a wavelength of an operational frequency band of the radio circuitry 14 (and the antenna). It should be appreciated that there may be multiple modes which are excited by the various combinations of the antenna 50, the first ground member 20 and the second ground member 22. It should also be appreciated that the term 'electrical length' is used in a general sense and includes paths that include portions having the same orientation and also paths that include portions which have different orientations.

In operation, the antenna is coupled to the feed point 40 and transmits and/or receives signals in the first frequency band. The antenna electromagnetically couples with at least the second ground member 22 (the antenna may also electromagnetically couple with the first ground member 20) and excites the resonant mode (having the electrical length 44) in the first ground member 20 and the second ground member 22. Consequently, the first and second ground members 20, 22 form part of the resonant structure of the apparatus 10 and are operable in the first frequency band.

Various embodiments of the present invention provide an advantage in that the second ground member 22 may optimize the electrical length of the first ground member 20 so that the apparatus 10 operates efficiently in a desired frequency band (the first frequency band for example). Usually, the dimensions of the first ground member 20 are out of the antenna designer's control since they are determined by the dimensions of the apparatus and the electronic components of the apparatus. Various embodiments of the invention provide an advantage in that the antenna designer may select the dimensions of the second ground member 22 so that the electrical length of the first and second ground member 20, 22 combination is optimized for a desired frequency band.

Figure 3:
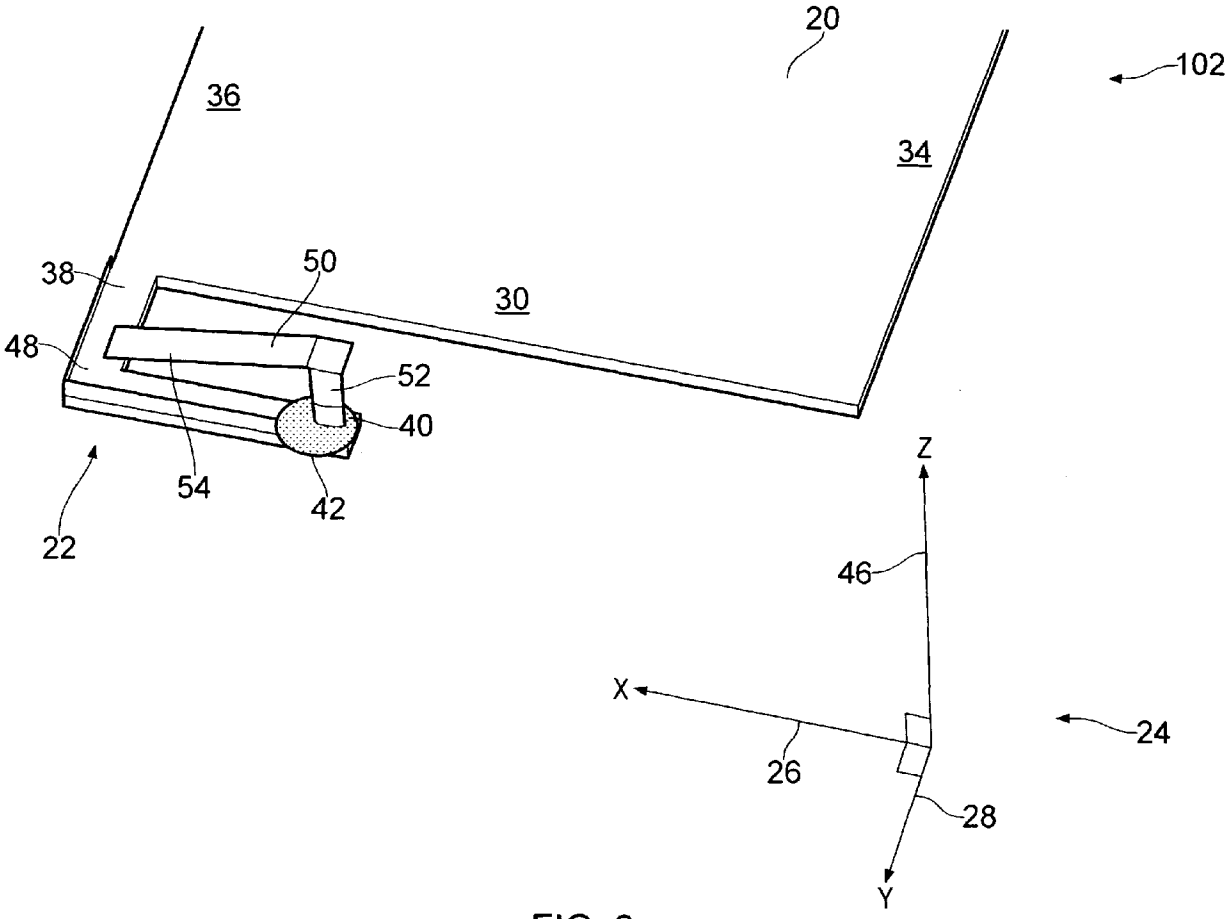
FIG. 3 illustrates a perspective view diagram of a further apparatus according to various embodiments of the present invention.

FIG. 3 illustrates a perspective view diagram of a further apparatus 102 according to various embodiments of the present invention. The apparatus 102 is similar to the apparatus 101 illustrated in FIG. 2 and where the features are similar, the same reference numerals are used. In this example, the Cartesian co-ordinate axis 24 additionally includes a Z axis 46 which is orthogonal to the X axis 26 and to the Y axis 28.

The first end 38 of the second ground member 22 extends from the corner of the first ground member 20 defined by the first edge 30 and the fourth edge 36 in the +Y direction. At position 48, the second ground member 22 makes a right angled left hand turn and then extends in the −X direction until the second end 40. The length of the second ground member 22 between the position 48 and the second end 40 is equal to approximately 40% of the length between the third edge 34 and the fourth edge 36. It should be appreciated that the second ground member 22 is hook or 'L' shaped.

Additionally, it should be appreciated that the second ground member 22 may have a length between the position 48 and the second end 40 greater than or less than 40% of the length between the third edge 34 and the fourth edge 36 (depending on the desired operational frequency bands and implementation).

The apparatus 102 also includes an antenna 50 that is connected to the feed point 42. The antenna 50 includes a first portion 52 that extends from the feed point 42 in the +Z direction and a second portion 54 that extends from the first portion 52 in the +X direction and has a negative gradient (that is, the second portion 54 slopes in the −Z direction towards the second ground member 22). In other embodiments it should be appreciated that the second portion 54 may extend in a substantially parallel manner with respect to the second ground member 22 in the −Z direction. The antenna 50 overlays the second ground member 22. The open end of the antenna 50 (that is, the free end of the second portion 54) overlays the second ground member 22 at position 48. The antenna 50 is configured to be operable in the first frequency band and is a quarter wavelength resonator.

It should be appreciated that the antenna 50 overlays the second ground member 22 (when the apparatus 102 is viewed in plan), but does not overlay the first ground member 20 or any slot therebetween. The slot between the second ground member 22 and the first ground member 20 is illustrated in FIG. 3 as an air filled slot, but in other embodiments it should be appreciated that the slot may be filled with other components and/or materials, for example, printed wiring board core material such as FR4, electronic components not related to the antenna but residing on the printed wiring board, or plastic parts within the apparatus 102. It should also be appreciated that the antenna 50 is oriented parallel to the portion of the second ground member 22 between the position 48 and the second end 40. This orientation may increase electromagnetic coupling between the second ground member 22 and the antenna 50 since they are located in relatively close proximity to one another along their respective lengths.

In some embodiments, the antenna 50 may be integrated with the second ground member 22 and connected to the first ground member 20 via a spring. In other embodiments, the antenna 50, the first ground member 20 and the second ground member 22 may all be integral with one another.

The first ground member 20 and the second ground member 22 have an electrical length that is configured to provide a resonant mode in the first ground member 20 and the second ground member 22 in the first frequency band. In this example, the electrical length extends from the feed point 42 in the +X direction until position 48, then extends in the −Y direction until the first end 38 of the second ground member 22 and then extends in the −X direction along the first edge 30 from the fourth edge 36 to the third edge 34. The electrical length is substantially equal to half a wavelength of the first frequency band (and thus enables a standing wave to form along the electrical length in the first frequency band).

Figure 4:
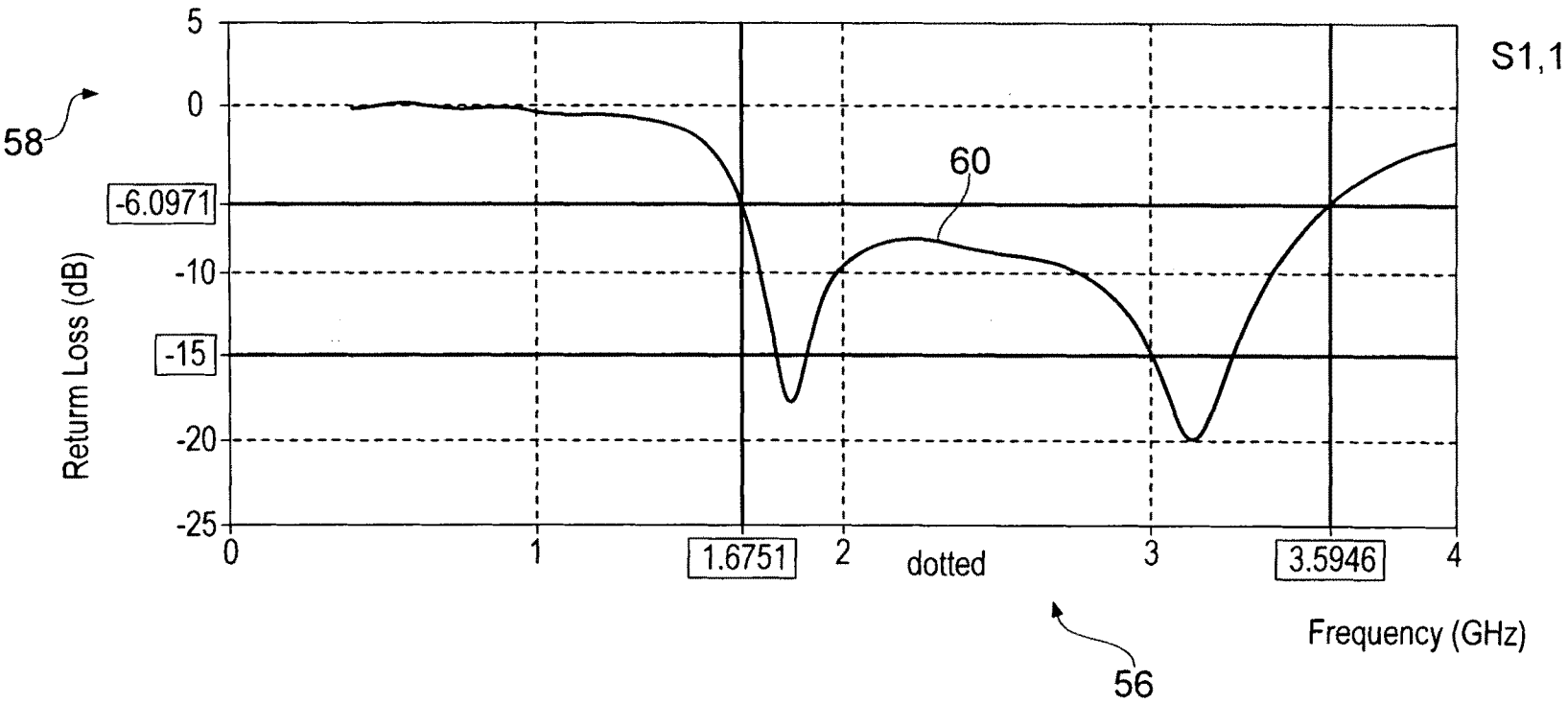
FIG. 4 illustrates a graph of frequency versus return loss for the apparatus illustrated in FIG. 3.

FIG. 4 illustrates a graph of frequency versus return loss for the apparatus 102 illustrated in FIG. 3. The graph includes a horizontal axis 56 that represents the operating frequency (in GHz) of the apparatus 102, and a vertical axis 58 that represents the return loss (in dB) of the apparatus 102. The graph also includes a line 60 that represents the variation of the return loss of the apparatus 102 with frequency.

The line 60 has a return loss of approximately 0 dB between 0 GHz and 1 GHz. The line 60 then has an increasingly negative gradient (with increasing frequency) and has a first minima of −17 dB at 1.85 GHz. The line 60 then has a decreasingly positive gradient (with increasing frequency) and has a maxima of −8 dB at 2.25 GHz. The line 60 then has an increasingly negative gradient (with increasing frequency) and has a second minima of −20 dB at 3.15 GHz. The line then has a decreasingly positive gradient (with increasing frequency) and has a return loss of −2 dB at 4 GHz. The line 60 also has a third minima of −9 dB at approximately 2.5 GHz provided by a resonance formed from the combination of the antenna 50, the second ground member 22 and the first ground member 20.

The frequency band provided by the first minima may correspond to the first frequency band mentioned in the preceding paragraphs. The second minima and third minima are provided by further resonant modes of the antenna 50 and ground members 20, 22 and increase the operational bandwidth of the apparatus 102. The frequency bands of the second and third resonant modes may be lowered due to electromagnetic coupling between the antenna 50 and the second ground member 22.

As indicated on the graph, the apparatus 102 has a return loss of −6 dB or better in the frequency range of 1.68 GHz to 3.59 GHz. Consequently, the apparatus 102 may operate in any operational frequency band that falls within this frequency range.

Various embodiments provide an advantage in that the physical arrangement or configuration of the antenna 50 relative to the second ground member 22 (and/or the relative arrangement of the first and second ground members 20, 22) may be chosen such that the impedance of the antenna 50 (measured at the feed point 42) in a desired frequency band corresponds to (or is similar to) the impedance of the radio circuitry 14 (the impedance may be fifty ohms for example).

For example, the second portion 54 of the antenna 50 illustrated in FIG. 3 is sloped downwards towards the second ground member 22 to increase capacitive coupling and thereby lower the frequency of at least the first minima. The increase in capacitive coupling may be achieved in other embodiments in various different ways. For example, a third portion 56 may extend from the open end of the second portion 54 towards the second ground member 22 in the −Z direction. The distance between the open end of the third portion 56 and the surface of the second ground member 22 being configured to provide the required capacitive loading.

Consequently, various embodiments of the present invention may not require an intervening matching circuit between the feed point 42 and the radio circuitry 14. This may advantageously reduce the cost and complexity in manufacturing the apparatus 102.

Various embodiments also provide an advantage in that the orientation of the second ground member 22 in the X axis does not significantly increase the length of the ground member 18 in the Y axis. Consequently, this may result in a relatively compact apparatus which may be desirable to users.

Figure 5:
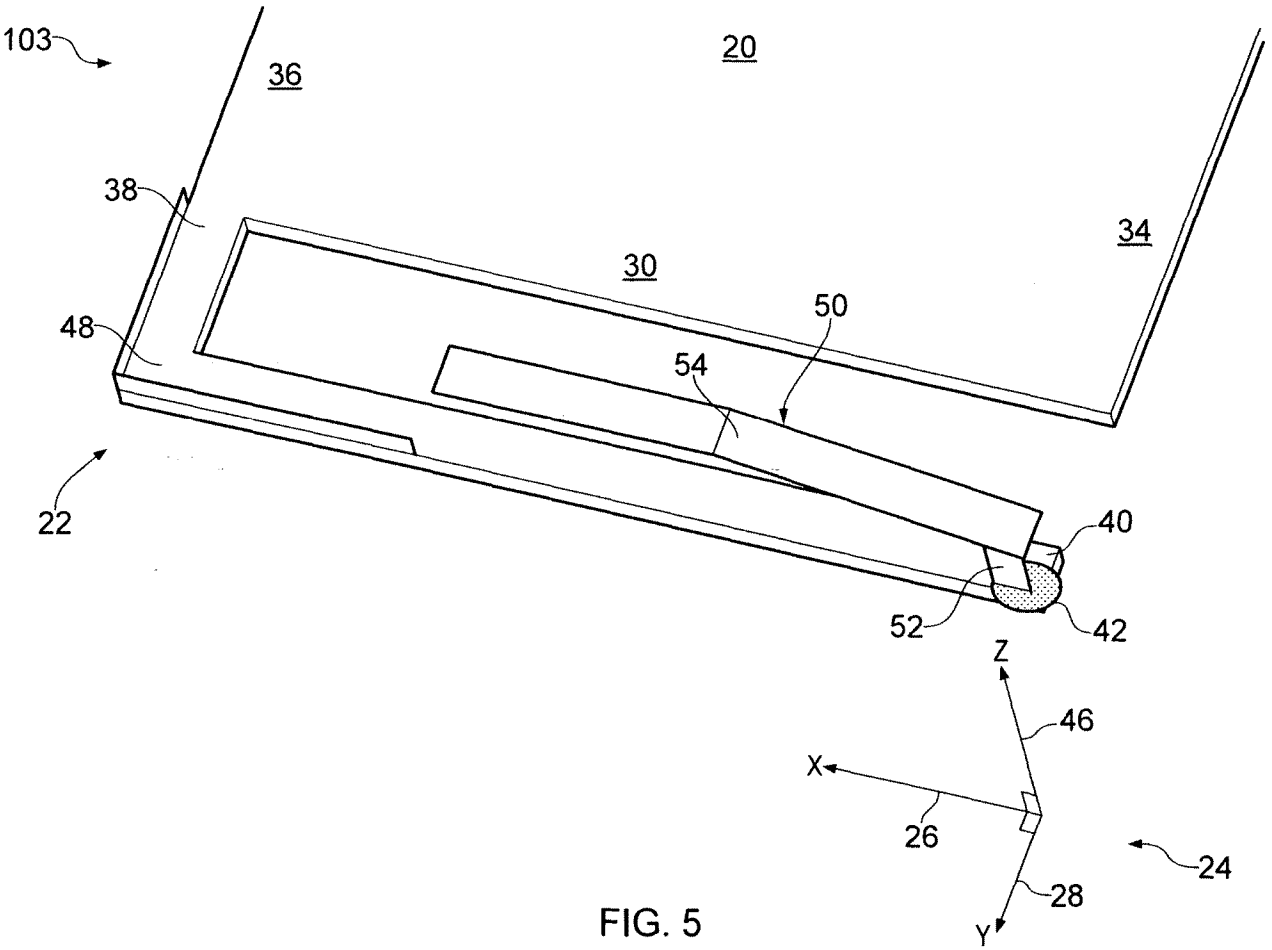
FIG. 5 illustrates a perspective view diagram of another apparatus according to various embodiments of the present invention.

FIG. 5 illustrates a perspective view diagram of another apparatus 103 according to various embodiments of the present invention. The apparatus 103 is similar to the apparatus 102 illustrated in FIG. 3 and where the features are similar, the same reference numerals are used.

The apparatus 103 differs from the apparatus 102 in that the length of the portion of the second ground member 22 between the position 48 and the second end 40 is equal to the width of the first ground member 20 between the third edge 34 and the fourth edge 36 (in other embodiments, the length of the second ground member 22 may be different to the width of the first ground member 20). Additionally, the second portion 54 of the antenna 50 extends from the first portion 52 in the +X direction and has a positive gradient for approximately half of its length (that is, the second portion 52 slopes away from the second ground member 22 in the +Z direction for half of its length).

In other embodiments, the second portion 54 may not have a positive gradient and may instead have a negative gradient or be oriented parallel to the second ground member 22.

The first ground member 20 and the second ground member 22 have an electrical length that is configured to provide a resonant mode in the first ground member 20 and the second ground member 22 in the first frequency band. In this example, the electrical length extends from the feed point 42 in the +X direction until position 48, then extends in the −Y direction until the first end 38 of the second ground member 22 and then extends in the −X direction and the −Y direction to the corner of the first ground member 20 defined by the second edge 32 and the third edge 34. The electrical length is substantially equal to half a wavelength of the first frequency band (and thus enables a standing wave to form along the electrical length in the first frequency band).

Figure 6:
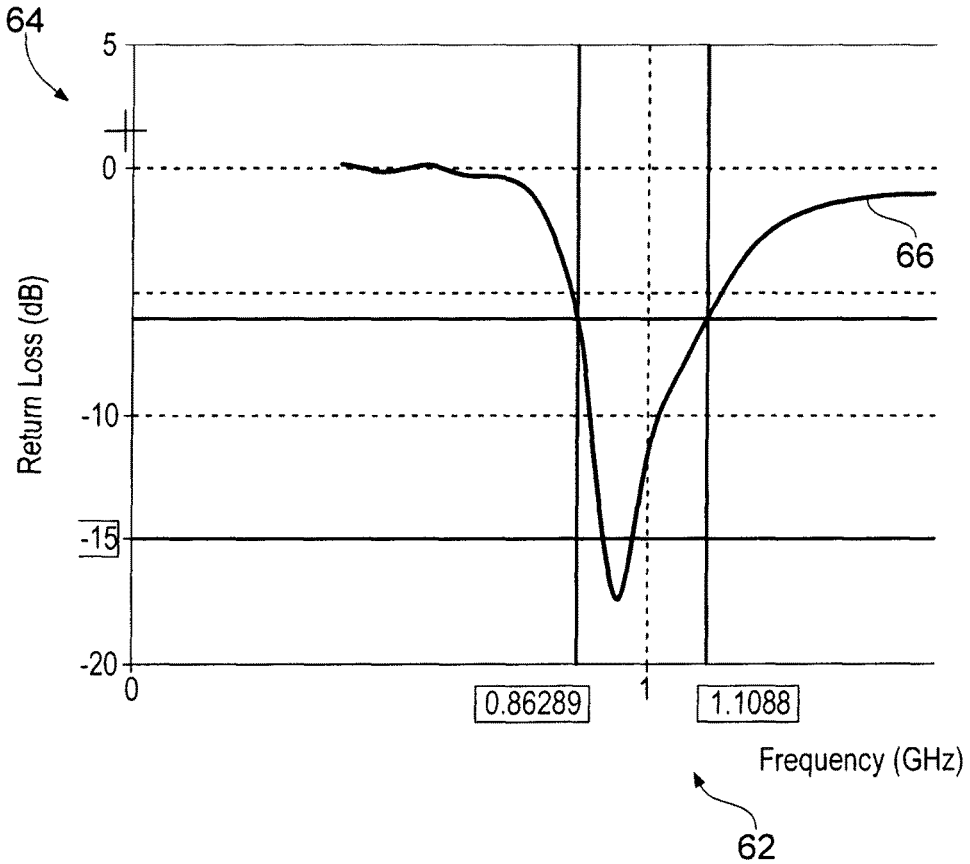
FIG. 6 illustrates a graph of frequency versus return loss for the apparatus illustrated in FIG. 5.

FIG. 6 illustrates a graph of frequency versus return loss for the apparatus 103 illustrated in FIG. 5. The graph includes a horizontal axis 62 that represents the operating frequency (in GHz) of the apparatus 103, and a vertical axis 64 that represents the return loss (in dB) of the apparatus 103. The graph also includes a line 66 that represents the variation of the return loss of the apparatus 103 with frequency.

The line 66 has a return loss of 0 dB between 0 GHz and 0.7 GHz. The line 66 then has an increasingly negative gradient (with increasing frequency) and has a minima of −17.5 dB at 0.94 Ghz. The line 66 then has a decreasingly positive gradient (with increasing frequency) and has a return loss −1 dB at 1.5 Ghz.

The frequency band provided by the first minima corresponds to the first frequency band mentioned in the preceding paragraphs. The apparatus 103 has a return loss of −6 dB or better in the frequency range of 0.86289 GHz to 1.1088 GHz. Consequently, the apparatus 102 may operate in any operational frequency band that falls within this frequency range. The apparatus 103 may also have a second minima (not illustrated in FIG. 6) at 1.7 GHz due to a further resonant mode of the antenna 50. This may advantageously increase the bandwidth of the apparatus 103.

The apparatus 103 provides an advantage in that it has a relatively low resonant frequency band and may consequently be operable in European global system for mobile communications band (EGSM) 900 (880-960 MHz) for example. In some embodiments, the apparatus 103 may be operable in European global system for mobile communications band (EGSM) 900 (880-960 MHz), global system for mobile communications band 850, wideband code division multiple access (WCDMA) V and VIII. This embodiment may be advantageously used where the dimensions of the device in which the apparatus 103 is incorporated are small relative to the desired operational wavelengths of the operational frequency band of interest.

Figure 7:
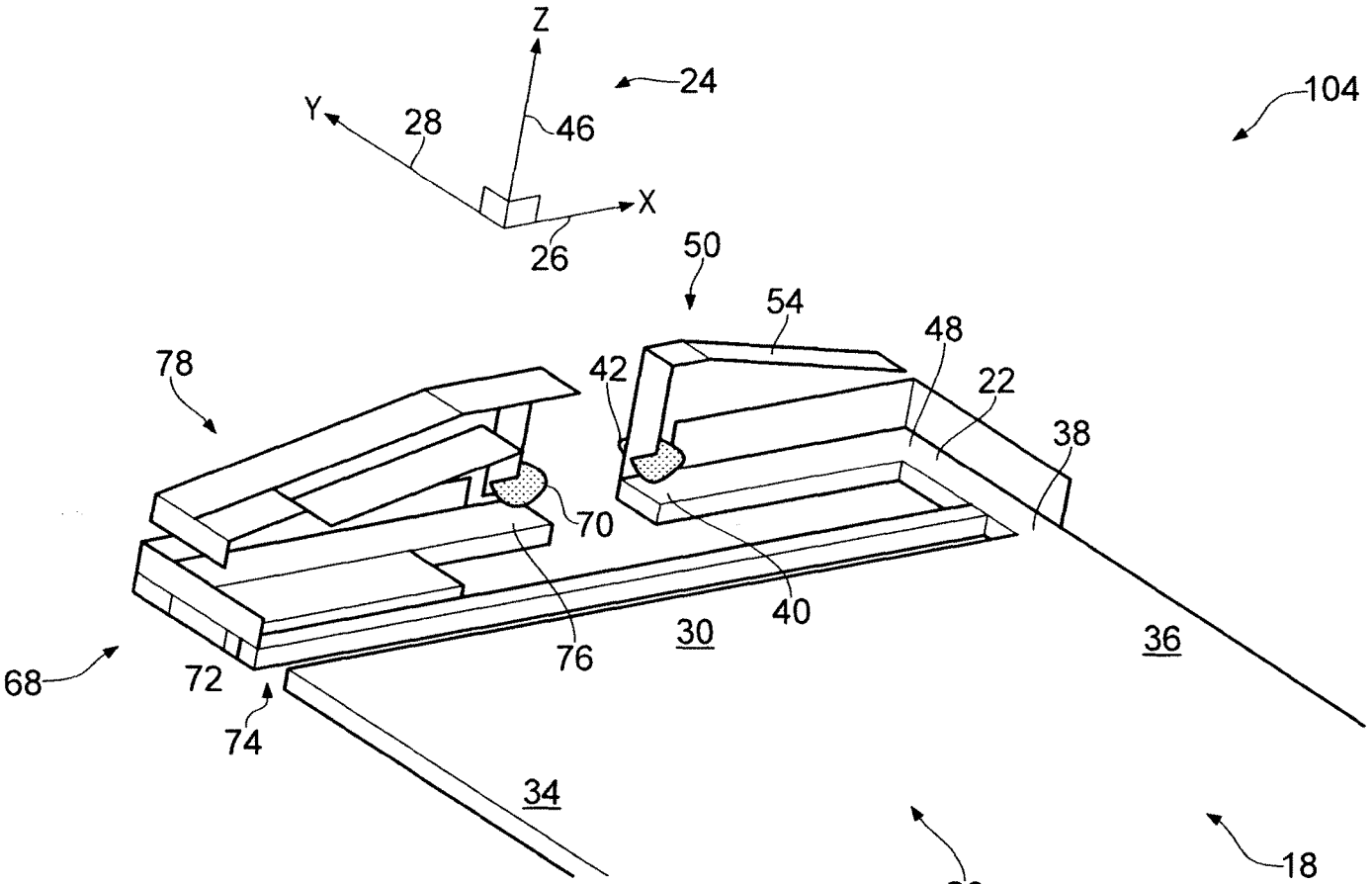
FIG. 7 illustrates a perspective view diagram of a further apparatus according to various embodiments of the present invention.

FIG. 7 illustrates a perspective view diagram of a further apparatus 104 according to various embodiments of the present invention. The apparatus 104 is similar to the apparatus 102 illustrated in FIG. 3 and where the features are similar, the same reference numerals are used.

The apparatus 104 differs from the apparatus 102 in that it additionally includes a third ground member 68 comprising a further feed point 70 that is configured to receive another antenna. The third ground member 68 extends in the −X direction from the portion of the second ground member 22 between the first end 38 and the position 48 until a position 72 (which has the same X axis 26 value as the third edge 34 of the first ground member 20). Consequently, the first ground member 20 and the third ground member 68 define a slot 74 therebetween. The third ground member 68 then makes a right angled right hand turn and extends in the +Y direction. The third ground member 68 then makes a right angled right hand turn and extends in the +X direction until an end point 76. The further feed point 70 is positioned at the end point 76. In other embodiments, the further feed point 70 may be positioned adjacent the end point 76 and a portion of the third ground plane 68 may extend from the further feed point 70 to the end point 76.

The third ground member 68 may be integral with the second ground member 22 (that is, they are both formed from a single block of material, a single printed wiring board for example) or they may be coupled together (by soldering for example). In other embodiments, the third ground member 68 may extend from the first ground member 20 instead of extending from the second ground member 22. In these embodiments, the third ground member 68 may be integral with the first ground member 20 or may be coupled to the first ground member 20.

The apparatus 104 also includes a second antenna 78 that is connected to the further feed point 70. The second antenna 78 extends from the further feed point 70 in the +Z direction and then makes a right angled left hand turn and extends in the −X direction with a negative gradient (that is, the further antenna 78 slopes downwards in the −Z direction towards the third ground member 68) until it has the same X axis 26 value as the third edge 34 of the first ground member 20. The second antenna 78 then makes a right angled left turn and extends in the −Y direction. The second antenna 78 then makes a right angled left turn and extends in the +X direction until an end point.

The second antenna 78 is configured to be operable in a second frequency band (different to the first frequency band of the antenna 50) and is a quarter wavelength resonator. The second antenna 78 may be any suitable antenna and may be any of those mentioned above with reference to the first antenna 50.

It should be appreciated that the second antenna 78 overlays the third ground member 68 (when the apparatus 104 is viewed in plan), but does not overlay the first ground member 20 or the slot between the first ground member 20 and the third ground member 68. It should also be appreciated that the further antenna 78 is oriented parallel to the third ground member 68 (since both the further antenna 78 and the third ground member 68 generally extend parallel to the X axis 26).

The first ground member 20, the third ground member 68 and (partially) the second ground member 22 have an electrical length that is configured to provide a resonant mode in the first ground member 20, the third ground member 68 and (partially) the second ground member 22 in the second frequency band. In this example, the electrical length extends from the further feed point 70, along the path formed by the structure of the third ground member 68, to the first end 38 of the second ground member 22 and to the corner of the first ground member 20 defined by the second edge 32 and the third edge 34. The electrical length is substantially equal to half a wavelength of the second frequency band (and thus enables a standing wave to form along the electrical length in the second frequency band).

In operation, the further antenna 78 transmits and/or receives signals in the second frequency band. The further antenna 78 electromagnetically couples with at least the third ground member 68 and excites the resonant mode described in the preceding paragraph. Consequently, the first, third and (partially) second ground members 20, 68, 22 form part of the resonant structure of the apparatus 104 and are operable in the second frequency band.

The apparatus 104 provides an advantage in that the ground member 18 is optimized to be operable in different frequency bands. For example, the second ground member 22 may optimize the ground member 18 to be operable in a relatively high frequency band (for example, EGSM 1800 (1710-1880 MHz) and the third ground member 68 may optimize the ground member 18 to be operable in a relatively low frequency band (for example, EGSM 900 (880-960 MHz)).

Figure 8:
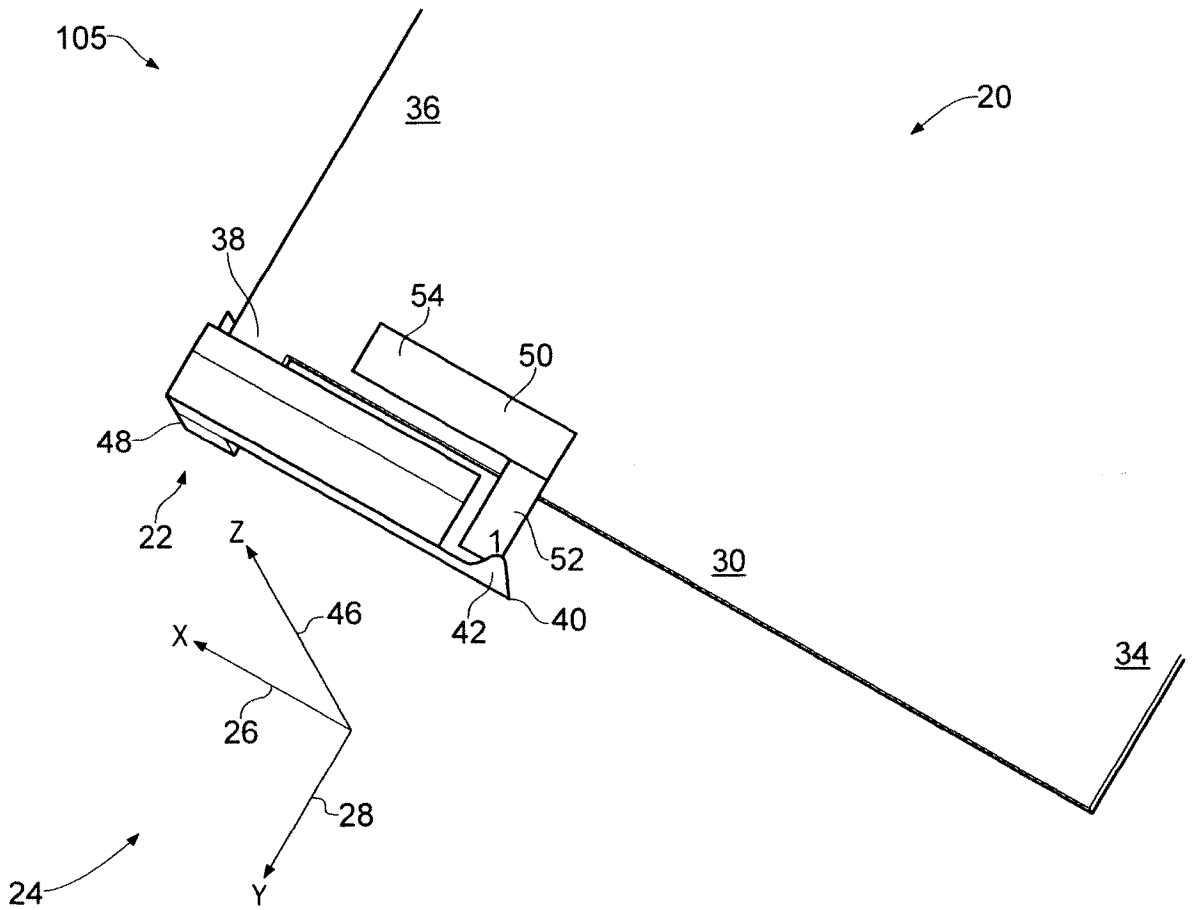
FIG. 8 illustrates a perspective view diagram of another apparatus according to various embodiments of the present invention.

FIG. 8 illustrates a perspective view diagram of another apparatus 105 according to various embodiments of the present invention. The apparatus 105 is similar to the apparatus 102 illustrated in FIG. 3 and where the features are similar, the same reference numeral are provided. The apparatus 105 differs from the apparatus 102 in that the second ground member 22 is not co-planar with the first ground member 20. Additionally, the antenna 50 does not overlay the second ground member 22 and instead, partially overlays the first ground member 20. In other embodiments, the antenna 50 may partially overlay at least a portion of the second ground member 22.

In more detail, the first end 38 of the second ground member 22 extends in the +Y direction from the corner of the first ground member 20 defined by the first edge 30 and the fourth edge 36. At position 48, the second ground member 22 makes a right angled turn and extends in the +Z direction. The second ground member 22 then makes another right angled turn and extends in the −X direction until the second end 40.

The first portion 52 of the antenna 50 extends from the feed point 42 in the −Y direction. The second portion 54 of the antenna 50 extends from the first portion 52 in the +X direction and at least partially overlays the first ground member 20.

The apparatus 105 may provide an advantage in that the relative proximity of the antenna 50 to the first ground member 20 (in comparison to the apparatus 102) may result in stronger electromagnetic coupling between the antenna 50 and the first ground member 20. Additionally, the apparatus 105 may be less affected by a user placing the apparatus 105 against his head (for example, to make a telephone call) than the apparatus 102 since the first ground member 20 may shield the antenna 50 from the user's head.

Figure 9:
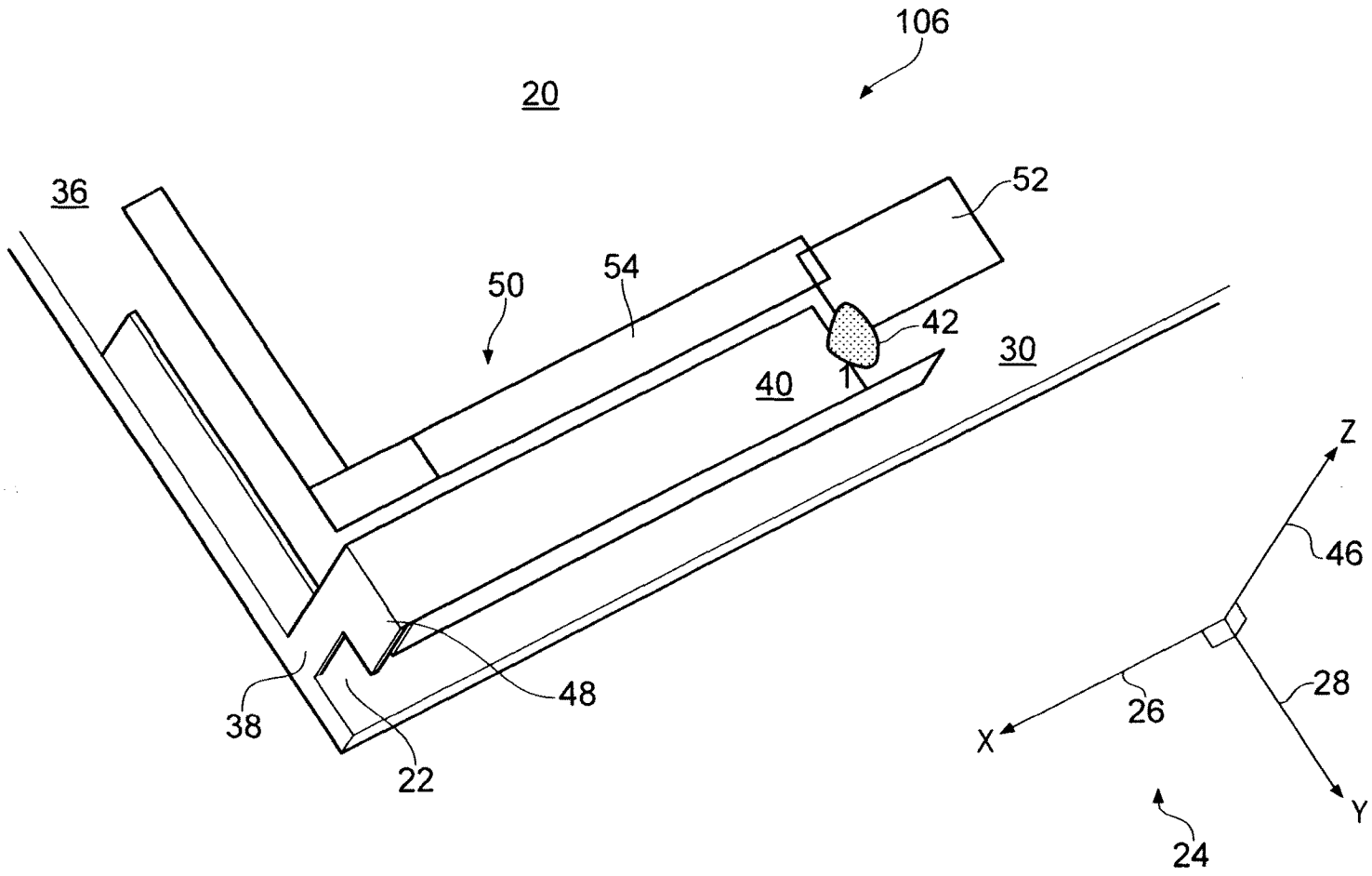
FIG. 9 illustrates a perspective view diagram of a further apparatus according to various embodiments of the present invention.

FIG. 9 illustrates a perspective view diagram of another apparatus 106 according to various embodiments of the present invention. The apparatus 106 is similar to the apparatus 102 illustrated in FIG. 3 and where the features are similar, the same reference numeral are provided. The apparatus 106 differs from the apparatus 102 in that the second ground member 22 is not co-planar with the first ground member 20. Additionally, the antenna 50 does not overlay the second ground member 22 and instead, overlays the first ground member 20.

In more detail, the first end 38 of the second ground member 22 extends in the +Z direction from the fourth edge 36 of the first ground member 20 in the corner defined by the first edge 30 and the fourth edge 36. At position 48, the second ground member 22 makes a right angled turn and extends in the −X direction until the second end 40. Consequently, the second ground member 22 overlays the first ground member 20 (when viewed in plan).

The first portion 52 of the antenna 50 extends from the feed point 42 in the −X direction. The second portion 54 of the antenna 50 extends from the first portion 52 in the +X direction and is parallel to the portion of the second ground member 22 which extends in the −X direction. The second portion 54 of the antenna 50 then makes a right angled turn and extends in the −Y direction until an end point.

The apparatus 106 may provide an advantage in that the relative proximity of the antenna 50 to the first ground member 20 (in comparison to the apparatus 102) may result in stronger electromagnetic coupling between the antenna 50 and the first ground member 20. Additionally, the apparatus 105 may be less affected by a user placing the apparatus 106 against his head (for example, to make a telephone call) than the apparatus 102 since the first ground member 20 may shield the second ground member 22 and the antenna 50 from the user's head.

Figure 10:
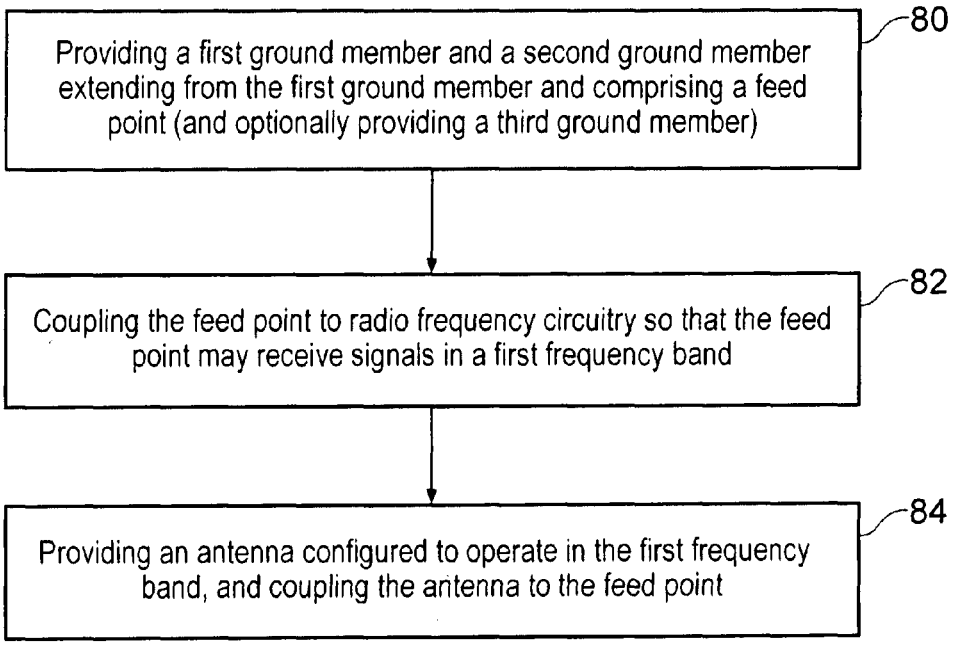
FIG. 10 illustrates a flow diagram for manufacturing an apparatus according to various embodiments of the present invention.

FIG. 10 illustrates a flow diagram for manufacturing an apparatus 10, 101, 102, 103, 104, 105 and 106 according to various embodiments of the present invention.

At block 80, the method includes providing a first ground member 20 and a second ground member 22 which extends from the first ground member 20 and comprises a feed point 42. Where the first and second ground members 20, 22 are integral, the method may include cutting or machining the first and second members 20, 22 from a single printed wiring board. Where the first and second ground members 20, 22 are not integral, the method may include coupling the first and second ground members 20, 22 together (for example, by soldering them together). The method may (optionally) include providing a third ground member 68.

At block 82, the method includes coupling the feed point 42 to the radio circuitry 14 so that the feed point 42 may receive signals in the first frequency band from the radio circuitry 14 and/or provide signals in the first frequency band to the radio circuitry 14. For example, the feed point 42 may be coupled to the radio circuitry 14 via a galvanic connection.

At block 84, the method includes providing an antenna 50 configured to operate in the first frequency band and coupling the antenna 50 to the feed point 42.

The blocks illustrated in FIG. 10 may represent steps in a method and/or sections of code in a computer program. The computer program may be executed by a controller to control machinery to perform the blocks in FIG. 10. The illustration of a particular order to the blocks does not necessarily imply that there is a required or preferred order for the blocks and the order and arrangement of the block may be varied. Furthermore, it may be possible for some blocks to be omitted.

Although embodiments of the present invention have been described in the preceding paragraphs with reference to various examples, it should be appreciated that modifications to the examples given can be made without departing from the scope of the invention as claimed. For example, in the above embodiments the various apparatus have been described having right angled turns. It should be appreciated that the apparatus may have turns that are more or less than ninety degrees and the turns may be curved.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

a first ground member;

a second ground member extending from the first ground member and configured to extend an electrical length of the first ground member to a first electrical length, wherein the second ground member comprises a feed point for an antenna configured to at least partially overlay the second ground member and to operate in a first frequency band, wherein the feed point is coupled to radio circuitry via the first ground member and the second ground member, the feed point being configured to receive a signal in the first frequency band; and a third ground member configured to extend an electrical length of the first ground member to a second electrical length, wherein the third ground member comprises a further feed point for a further antenna configured to operate in a further frequency band, different to the first frequency band, wherein the further feed point is configured to receive a signal in the further frequency band, wherein the second ground member is configured to match a resonant frequency of the first electrical length with the operational frequency band of the antenna, and wherein the third ground member is configured to match a resonant frequency of the second electrical length with the operational frequency band of the further antenna.

2. An apparatus as claimed in claim 1, wherein the first ground member and the second ground member are integral with one another.

3. An apparatus as claimed in claim 1, wherein the second ground member is elongate and has a first end and a second opposite end, the second ground member being coupled to the first ground member at the first end, the second end being open.

4. An apparatus as claimed in claim 3, wherein the feed point is positioned at or adjacent the second end of the second ground member.

5. An apparatus as claimed in claim 1, wherein the feed point is coupled to radio circuitry without an intervening matching circuit between the feed point and the radio circuitry, or wherein the feed point is coupled to radio circuitry via an intervening matching circuit.

6. An apparatus as claimed in claim 1, further comprising the antenna configured to operate in the first frequency band, the antenna being coupled to the feed point and at least partially oriented parallel to the second ground member.

7. An apparatus as claimed in claim 6, wherein the antenna wholly overlays the second ground member, or wherein the antenna at least partially overlays the first ground member, or wherein the antenna overlays the second ground member, but does not overlay the first ground member or any slot therebetween.

8. An apparatus as claimed in claim 1, wherein the third ground member extends from the first ground member.

9. An apparatus as claimed in claim 8, wherein the electrical length of the second ground member is different to the electrical length of the third ground member.

10. A module or a portable electronic device comprising an apparatus as claimed in claim 1.

11. An apparatus as claimed in claim 1, wherein the first ground member, the second ground member and the third ground member are formed from a printed wiring board and at least a portion of an external conductive casing of the apparatus.

12. A method comprising:

providing:

a first ground member;

a second ground member extending from the first ground member and configured to extend an electrical length of the first ground member to a first electrical length, wherein the second ground member comprises a feed point for an antenna configured to at least partially overlay the second ground member and to operate in a first frequency band, wherein the feed point is coupled to radio circuitry via the first ground member and the second ground member, the feed point being configured to receive a signal in the first frequency band; and a third ground member configured to extend an electrical length of the first ground member to a second electrical length, wherein the third ground member comprises a further feed point for a further antenna configured to operate in a further frequency band, different to the first frequency band, whererin the further feed point is configured to receive a signal in the further frequency band, wherein the second ground member is configured to match a resonant frequency of the first electrical length with the operational frequency band of the antenna, and wherein the third ground member is configured to match a resonant frequency of the second electrical length with the operational frequency band of the further antenna.

13. A method as claimed in claim 12, wherein the second ground member is elongate and has a first end and a second opposite end, the second ground member being coupled to the first ground member at the first end, the second end being open.

14. A method as claimed in claim 13, wherein the feed point is positioned at or adjacent the second end of the second ground member.

15. A method as claimed in claim 12, further comprising providing the antenna configured to operate in the first frequency band, and coupling the antenna to the feed point so that the antenna is oriented at least partially parallel to the second ground member.

16. A method as claimed in claim 15, or wherein the antenna wholly overlays the second ground member, or wherein the antenna at least partially overlays the first ground member, or wherein the antenna overlays the second ground member, but does not overlay the first ground member or any slot therebetween.

17. A method as claimed in claim 12, wherein the third ground member extends from the first ground member.

18. A method as claimed in claim 17, wherein the electrical length of the second ground member is different to the electrical length of the third ground member.

19. A method as claimed in claim 12, wherein the first ground member, the second ground member and the third ground member are formed from a printed wiring board and at least a portion of an external conductive casing of the apparatus.

20. An apparatus comprising:

a first ground member;

a second ground member extending from the first ground member and configured to extend an electrical length of the first ground member to a first electrical length, wherein the second ground member comprises a feed point for an antenna configured to at least partially overelay the second ground member and to operate in a first frequency band, wherein the feed point is coupled to radio circuitry via the first ground member and the second ground member, the feed point configured to receive a signal in the first frequency band, wherein the second ground member is configured to match a resonant frequency of the first electrical length with the operational frequency band of the antenna;

a third ground member comprising a further feed point for a further antenna; and wherein said radio circuitry is coupled to the antenna to enable transmission and reception and coupled to the further antenna to enable transmission and reception.

* * * * *